United States Patent [19]

Beck

[11] 4,365,745

[45] Dec. 28, 1982

[54] DIAPHRAGM PUMP

[76] Inventor: Louis Beck, 6399 Crossview Rd., Seven Hills, Ohio 44131

[21] Appl. No.: 231,746

[22] Filed: Feb. 5, 1981

[51] Int. Cl.[3] ..... B05B 9/03

[52] U.S. Cl. ..... 239/124; 239/332; 417/387

[58] Field of Search ..... 239/124, 332, 526, DIG. 14; 417/386, 387, 388

[56] References Cited

U.S. PATENT DOCUMENTS

| | | | |
|---|---|---|---|
| 3,141,303 | 7/1964 | Baldwin | 417/387 |
| 3,285,182 | 11/1966 | Pinkerton | 417/386 |
| 3,788,554 | 1/1974 | Guise | 239/332 |
| 3,884,598 | 5/1975 | Wanner | 417/386 |

*Primary Examiner*—John J. Love
*Assistant Examiner*—Michael J. Forman
*Attorney, Agent, or Firm*—Maky, Renner, Otto & Boisselle

[57] ABSTRACT

A hydraulically actuated pump of the piston-diaphragm type for pumping a liquid such as paint through an airless spray gun having a flexible hose which is connected to the pump outlet downstream of the outlet check valve and which has a volumetric capacity many times the displacement of the diaphragm actuating piston to constitute an elastically expansible and contractible pressure storage vessel. The driving fluid chamber of the pump between the piston and diaphragm has a restricted adjustable pressure control valve to control the operating pressure of the pump and an automatic hydraulic inlet-outlet valve operative upon arrest of the return movement of the diaphragm, to admit driving fluid from a reservoir into the driving fluid chamber during the continued terminal portion of return stroke of the piston and to permit expulsion of driving fluid from the driving fluid chamber to the reservoir during the initial portion of the pressure stroke of the piston to adjust the volume of hydraulic fluid between the piston and diaphragm thus to maintain a predetermined rate of discharge of the pumped liquid through the spray gun during the pressure and return strokes of the diaphragm and piston. During the return stroke of the diaphragm and piston, the outlet check valve closes so that continued return movement of the piston draws the diaphragm with it to the stop position to draw in through an inlet check valve liquid to be pumped during the next pressure stroke of the piston and diaphragm.

In standby operation of the pump with continued reciprocation of the piston, the pressure control valve opens to decrease the volume of driving fluid to correspond to the net displacement of the diaphragm for continued back and forth flow of pumped liquid into and from the pressure storage vessel, the outlet check valve being of light weight material having a specific gravity only slightly greater than that of the liquid being pumped and having a relatively large opening movement so that it does not engage its seat during the back and forth movements of the piston and diaphragm during standby operation.

3 Claims, 3 Drawing Figures

DIAPHRAGM PUMP

BACKGROUND OF THE INVENTION

In known hydraulically actuated diaphragm pumps of the piston-diaphragm type, the piston displacement is usually equal to or greater than the displacement of the diaphragm and in the latter instance when the diaphragm reaches the end of its pressure stroke, excess driving fluid is conducted to a reservoir via a relief valve and during the return stroke of the piston the diaphragm is retracted and when it reaches the end of its return stroke a check valve opens to conduct driving liquid from the reservoir into the driving liquid chamber.

In another known form of hydraulically actuated diaphragm pump the piston displacement is equal to the diaphragm displacement, a relief valve being opened by expansion of the driving liquid at the end of the pressure stroke of the piston and being mechanically opened at the end of the suction stroke of the piston to admit driving liquid lost by leakage or by contraction of the driving liquid.

In these hydraulically actuated pumps, if the pump outlet is blocked as by closing of a valve, the diaphragm movement ceases and the entire displacement of the piston is conducted through a relief valve to the driving liquid reservoir and as the piston is retracted the inlet check valve opens to conduct driving liquid from the reservoir into the driving liquid chamber. In the case of high speed pumps, cavitation is likely to occur owing to lack of sufficient flow capacity of the inlet check valve.

SUMMARY OF THE INVENTION

A diaphragm pump is provided for use with an airless spray gun in which the flexible hose connected between the pump and the spray gun constitutes an elastic storage vessel for the pumped liquid and which in conjunction with the pump outlet check valve utilizes the kinetic energy in the pumped liquid during a portion of the return stroke of the diaphragm and piston while continuing the spraying of the liquid during the pressure and return strokes of the diaphragm and piston.

The diaphragm pump herein employs in the driving liquid chamber a restricted relief valve and a self-adjusting lost motion inlet-outlet valve which achieves pressure and volume control of the driving liquid for pumping liquid through the spray gun at a predetermined pressure and rate.

The diaphragm pump herein in conjunction with a delayed closing outlet check valve and the aforesaid driving liquid restricted adjustable pressure control and inlet-outlet valves enables standby operation with the spray gun closed without interruption of back and forth motion of the driving liquid and back and forth motion of the driven liquid into and from the storage vessel and accompanying resilient expansion and contraction thereof.

DETAILED DESCRIPTION OF THE PREFERRED EMBODIMENT

Figure 1:
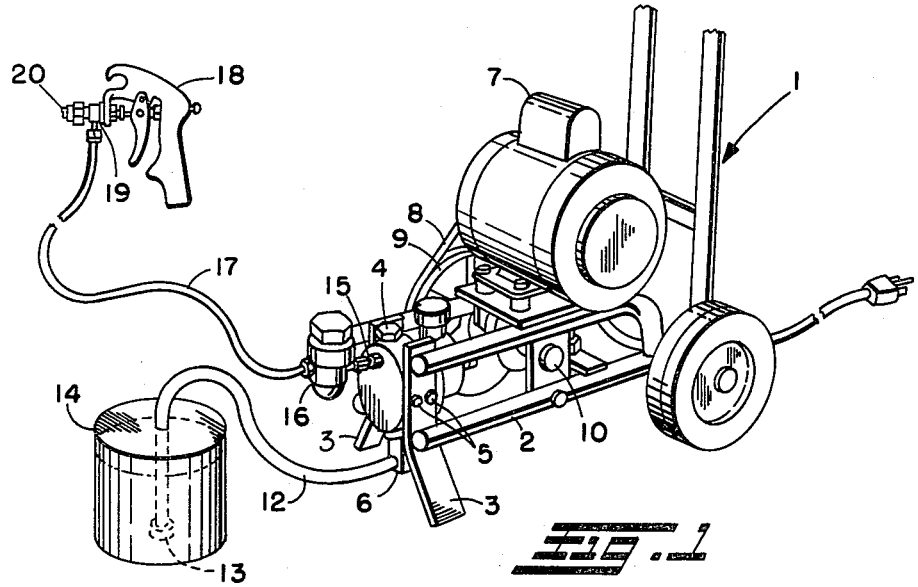
FIG. 1 is a perspective view of a portable airless spray system employing a hydraulically actuated pump according to the present invention.

FIG. 1 illustrates a portable airless spray system comprising a two-wheel cart 1 having a forwardly extending frame 2 with legs 3 supporting the frame in horizontal position as shown. The pump assembly 4 constituting the present invention is secured as by the screws 5 between the legs 3 with the inlet 6 disposed at the bottom for siphon feed or at the top for gravity feed.

Secured on the frame 2 is an electric drive motor 7 which through the belt 8 drives a pulley 9 secured on one end of a crankshaft 10 which is journaled at its ends in the frame 2. A crank pin at the middle of the crankshaft 10 imparts reciprocatory motion to a pump operating piston 11 as described in detail with reference to FIGS. 2 and 3. A suction hose 12 is connected to the inlet port 6 and its other end is provided with the usual filter 13 and is immersed in liquid to be sprayed which is contained in a can 14. The outlet port 15 has a filter 16 to which an elongated flexible hose 17 is connected. At the end of the hose 17 is a conventional airless spray gun 18 having a lever-operated on-off valve 19 and having a spray tip 20 for spraying the driven liquid.

Figure 2:
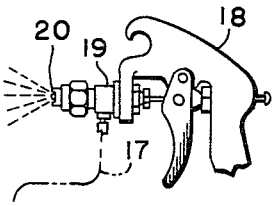
FIG. 2 is a vertical cross-section view of a preferred form of piston-diaphragm pump.
Figure 2:
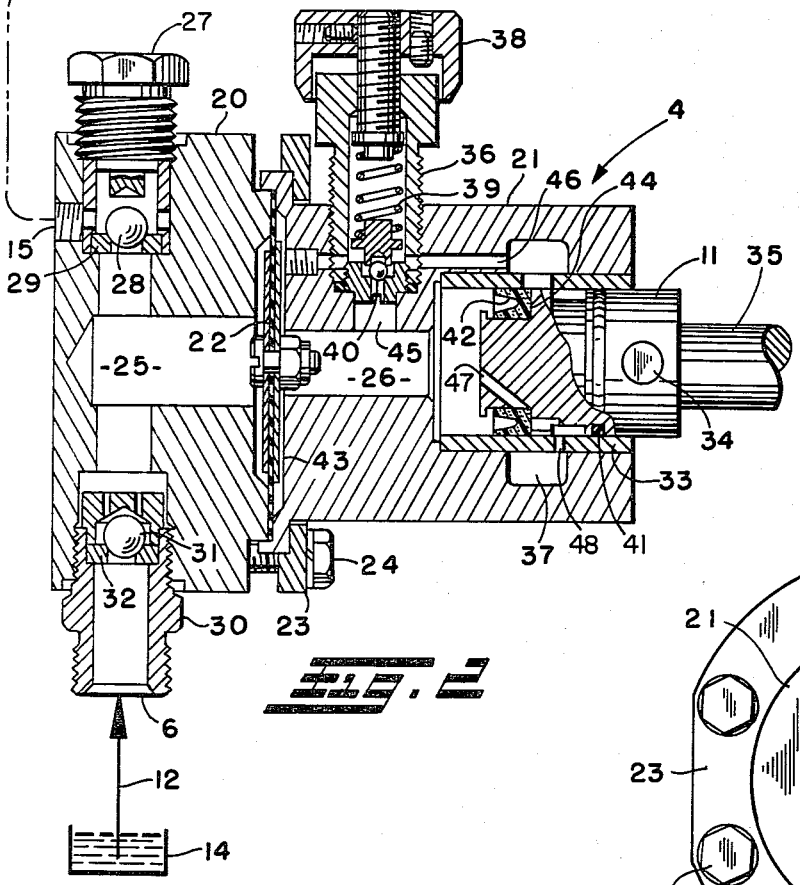
Figure 3:
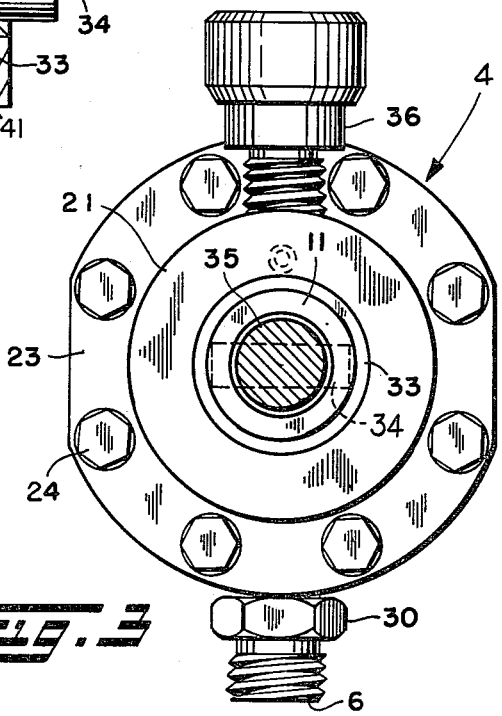
FIG. 3 is an end view as viewed from the righthand end of FIG. 2.

As best shown in FIGS. 2 and 3, the pump 4 herein is a hydraulically actuated pump of the piston-diaphragm type.

The pump 4 comprises housing parts 20 and 21 preferably of good heat conducting metal such as aluminum alloy between which the peripheral portion of a flexible diaphragm 22 is clamped as by the ring 23 and screws 24 to define a pumping chamber 25 and an actuating chamber 26. Screwed into the housing part 20 is an outlet check valve cartridge 27 having a light weight ball 28 as of nylon or like material movable out of engagement with the seat 29 to permit flow of driven liquid from the pumping chamber 25 through the flexible hose 12 and through the spray gun nozzle tip 20 when the spray gun valve 19 is open. Also screwed into the housing part 20 is an inlet check valve cartridge 30 similarly including a light weight ball 31 as of nylon which is moved out of engagement with the seat 32 to permit supply of driven liquid from the can 14 through hose 12 into the pumping chamber 25 when there is a partial vacuum in said chamber.

The housing part 21 has a tubular cylinder 33 shrink fitted or otherwise secured therein to constitute a cylinder for the piston 11 which is connected as by the wrist pin 34 to the piston rod 35 which is reciprocated responsive to rotation of the crankshaft 10. The housing part 21 has screwed therein a cartridge-type restricted pressure control valve 36 which communicates the driving liquid chamber 26 with a reservoir 37 when the pressure in the driving fluid chamber exceeds that for which the valve 36 is set by turning knob 38 to vary the compression of the spring 39 acting on the ball 40.

The pistion 11 is slidably sealed in the cylinder 33 as by the O-ring 41 and a packing ring 42 having a lost-motion sliding fit on a reduced diameter portion of the pistion 11. The packing ring 42 forms with the piston 11 an inlet-outlet valve operative after the diaphragm engages the stop wall 43 to open communication between the drive chamber 26 and reservoir 37 during the remaining portion of the return stroke of the piston 11 and during the corresponding initial portion of the pressure stroke of the piston 11 whereafter the packing ring 42 slides to closed position as shown to drive the diaphragm away from wall 43. A partial vacuum in chamber 26 acting on packing ring 42 overcomes the sliding friction on the reduced diameter portion of piston 11 for return movement of the piston 11 with respect to the packing ring 42 to open communication through passages 47 and 48 in the piston 11 and cylinder 33. During the initial portion of the pressure stroke of the piston 11 the piston passages remain open until there is relative movement to engage packing ring 42 with shoulder 44.

When it is desired to fill the driving liquid reservoir 37 and driving liquid chamber 26 with driving liquid, the pressure control valve cartridge 36 is unscrewed from the housing part 21 whereupon driving liquid may be introduced through the passages 45 and 46. The driving liquid may, for example, be a glycol-base material such as ethylene glycol.

It is generally assumed that liquids are noncompressible but it has been observed that hydraulic oil for example is compressed 1.2% at 3,000 psi and for light hydrocarbons at 2,000 to 3,000 psi the compression may be 5% or more. High pressure flexible hose 17 such as used herein is generally regarded as nonexpansible under pressure, but actually the expansion (following Hooke's Law) may be about 6% at 3,000 psi. By way of example, the hose 17 may be of $\frac{1}{4}''$ ID and usually of 25 ft. or 50 ft. length whereby its volumetric capacity may be about fifty or one hundred times the displacement of $1\frac{1}{4}''$ piston 11 having a $\frac{1}{4}''$ stroke. In that case, pressure energy may be stored in the hose 17 to maintain a predetermined rate of discharge from the spray gun 18 during the pressure and return strokes of the diaphragm 22 and pistion 11 and to maintain a positive pressure on the diaphragm 22 and piston 11 during a substantial portion of the return strokes thereof whereupon during the terminal portions of the return strokes fluid is drawn into pumping chamber 25 until diaphragm 22 engages wall 43 and continued return movement of the piston 11 creates an increased partial vacuum in the driving fluid chamber 26 to open the inlet-outlet valve defined by piston 11 and packing ring 42 to admit and expel fluid into and from the driving chamber 26.

The restricted pressure relief valve may have a bore of 0.120" which is engaged by a ball of 0.156" diameter.

In FIG. 2 the piston 11 is shown in its retracted bottom dead center position and as evident the piston motion is simple harmonic motion and as it moves toward the left on its pressure stroke the actuating liquid in chamber 26 will cause similar left movement of the diaphragm 22 to that of the piston 11 but of smaller magnitude. The diaphragm 22 movement displaces driven liquid in pumping chamber 25 past the outlet check valve 26 through the flexible hose 12 and through the spray tip 20. As the piston 11 initiates its return stroke, the pressure energy stored in the hose 17 acts on the diaphragm 22 and piston due to delayed closing of the light weight outlet check valve ball 28 and operation of the crankshaft 10 at say 625 rpm whereby on the next pressure stroke additional pressure energy is built up in the hose 17 until the pressure in the driven and driving fluid chambers 25 and 26 is sufficient to momentarily open the restricted pressure control valve 36 which has the effect of decreasing the volume of the driving liquid in the driving chamber 26 by movement of the diaphragm 22 toward the stop position engaged with wall 43 whereafter continued retraction of the piston 11 creates a partial vacuum acting on the area of the packing ring 42 so that continued retraction of the reduced portion of the piston 11 allows flow of driving liquid from the reservoir 37 into the driving liquid chamber 26. As the piston 11 commences to make its pressure stroke, the packing ring 42 and piston 11 driving liquid will be expelled from the driving liquid chamber 26 into the reservoir until the relative movement of the packing ring 43 and piston 11 closes the piston passages and thereafter to build up pressure in the driving liquid chamber 26 to initiate movement of the diaphragm 22 toward the left away from the stop wall 43 to maintain a predetermined rate of discharge through the spray gun 18 at predetermined pressure without high pressure bypassing of driving liquid as in prior art constructions.

The embodiments of the invention in which an exclusive property or privilege is claimed are defined as follows:

1. An airless spray system comprising a hydraulically actuated pump of the piston-diaphragm type in which a piston reciprocating in an actuating chamber filled with actuating liquid reciprocates a flexible diaphragm to pump liquid to be sprayed out of a pumping chamber through an outlet check valve and to draw in liquid from a supply source into said pumping chamber through an inlet check valve; an airless spray gun having a flexible hose connected to the pump outlet, said hose having a volumetric capacity many times larger than the displacement of said piston and being resiliently expansible and contractible to constitute a pressure storage vessel to receive an excess of liquid during the pressure stroke of said piston and diaphragm to maintain a substantially constant rate of discharge of liquid from said spray gun during the pressure and return strokes of said diaphragm and piston, said actuating chamber having a restricted pressure control valve which when open provides a restricted orifice to bleed actuating liquid into an actuating liquid reservoir when the liquid pressure in said pumping chamber and actuating chamber exceeds that for which said pressure control valve has been set and prior to the time that said piston reaches the end of its pressure stroke, said valve when open providing for completion of the pressure stroke of said piston without substantial drop in pressure in said chambers so that during a succeeding return stroke return movement of said diaphragm is arrested by a stop wall of said actuating chamber prior to the completion of the return stroke of said piston, said actuating chamber having an inlet-outlet valve which opens in response to a partial vacuum in said actuating chamber during the terminal portion of the return stroke of said piston for flow of actuating liquid from said reservoir into said actuating chamber and which remains open during the initial portion of the pressure stroke of the piston to expel actuating liquid from said actuating chamber into said reservoir; said inlet-outlet valve comprising a packing ring slidably sealed in a cylinder in said actuating chamber and on a reduced diameter extension of said piston to provide a lost motion connection between positions closing and opening passages in said piston and cylinder intercommunicating said reservoir and actuating chamber.

2. The system of claim 1 wherein said piston has a shoulder which is engaged by and spaced from said packing ring in the respective passage closing and opening positions of said packing ring.

3. The system of claim 2 wherein the passage in said piston has an intermediate portion which is opened or closed by sliding of said packing ring on said extension out of or into engagement with said shoulder.

* * * * *